United States Patent [19]

Kelly

[11] 4,284,299

[45] Aug. 18, 1981

[54] INTEGRAL HANDLE STOP AND LATCH MEMBER FOR SLIDING SCREEN CLOSURES

[76] Inventor: Donald V. Kelly, 15903 Condor Ridge Rd., Canyon Country, Calif. 91351

[21] Appl. No.: 5,475

[22] Filed: Jan. 22, 1979

[51] Int. Cl.[3] ..... E05C 19/06

[52] U.S. Cl. ..... 292/87; 292/DIG. 46; 292/DIG. 38

[58] Field of Search ..... 292/87, 88, 89, DIG. 38, 292/DIG. 49, DIG. 30, DIG. 31

[56] References Cited

U.S. PATENT DOCUMENTS

| | | | |
|---|---|---|---|
| 527,512 | 10/1894 | Scheuer | 292/87 |
| 2,870,882 | 1/1959 | Tolman | 292/87 X |
| 2,947,559 | 8/1960 | Olsson | 292/DIG. 30 |
| 3,065,985 | 11/1962 | Du Four | 292/DIG. 46 |
| 4,114,934 | 9/1978 | Kelly | 292/87 |

*Primary Examiner*—Richard E. Moore

*Attorney, Agent, or Firm*—John E. Wagner

[57] ABSTRACT

A molded plastic assembly for sliding screen closures employing a body made up of two separate parts which embrace the frame of a sliding screen closure and including an integral deflectable latching finger having an end portion which acts as a stop and which may be locked or unlocked by mere finger pressure against the deformable locking finger in order to engage or disengage from the door frame. The handle assembly employs the resilient characteristics of the material from which it is produced to provide the deflectable latching finger.

8 Claims, 7 Drawing Figures

INTEGRAL HANDLE STOP AND LATCH MEMBER FOR SLIDING SCREEN CLOSURES

BACKGROUND OF THE INVENTION

The provision of the locking member and handle for screen closures particularly those associated with sliding glass doors and windows has presented a challenge to the designers of these types of closures. The screen, unnecessary adjunct to a door or window is often overlooked insofar as the hardware used to open and close the screen. There is typically very little clearance between the screen and the adjacent door so that the handle must be of minimum thickness. It cannot interfere with the movement of the door or window and it cannot effectively be produced and then secured to the screen frame by punching or notching the frame as is commonly done in the lock mechanisms of sliding doors. This later is true because the frame for a sliding screen is usually relatively small and any punching or weakening of any type, particularly at the middle region between top and bottom can result in the door frame collapsing when someone applies abnormal force to the screen frame.

Of additional significance is the fact that the screen door or window constitutes a relatively low priced item and the handle and latch mechanism, although it must meet all of the foregoing requirements, must also be of minimum cost and high degree of reliability.

I have faced a similar problem in the field of frameless sliding window latches and have produced the one piece latch and handle mechanism disclosed and claimed in my U.S. Pat. No. 4,114,934. In that Patent, an integral pair of jaws served to engage and lock a window in the closed position and include an upstanding or outward extending handle portion to be manipulated by the user. Such arrangement however is neither required nor allowed for sliding screen closures because of the thickness clearance limitations and the normal lack of any member for the jaws to close upon.

BRIEF STATEMENT OF THE INVENTION

Faced with this state of the art I have invented an improved, effective, low-cost handle, latch and release mechanism for sliding screen closures.

The handle mechanism of my invention requires only the drilling of two holes through the screen frame which are subsequently filled with the securing screws cooperating with a pair of longitudinally extending flat plate portions of the handle assembly serves to reinforce or strengthen the frame in the region of the handle.

The handle assembly includes a pair of generally flat members each of which have mating cavities one on each side of the finished assembly to provide a finger recess for movement of the screen. The recess is sufficient to receive as many as four fingers allowing their pressure to one side of the recess to open the screen and to the opposite side of the recess to close the screen. The handle portions each include a step dimensioned to receive the screen frame there between.

One of the plate-like members defining the handle includes an integral locking finger which extends outward from the plane of the door. This locking finger includes an end catch which extends longitudinally and presents a stop surface which allows the door to automatically be closed but not latched so that it may be opened from either inside or outside when closed in a normal manner. The door may not be inadvertently locked from the exterior.

The locking finger includes an integral recess preferably of circular form which acts as a target for the finger when the finger is intended to be depressed. The forefinger of the user applied to the center of the recess can either lock or unlock the screen door.

BRIEF DESCRIPTION OF THE DRAWING

The features described above may be marked clearly understood by reference to the following detailed description and the drawing in which.

DETAILED DESCRIPTION OF THE INVENTION

Figure 1:
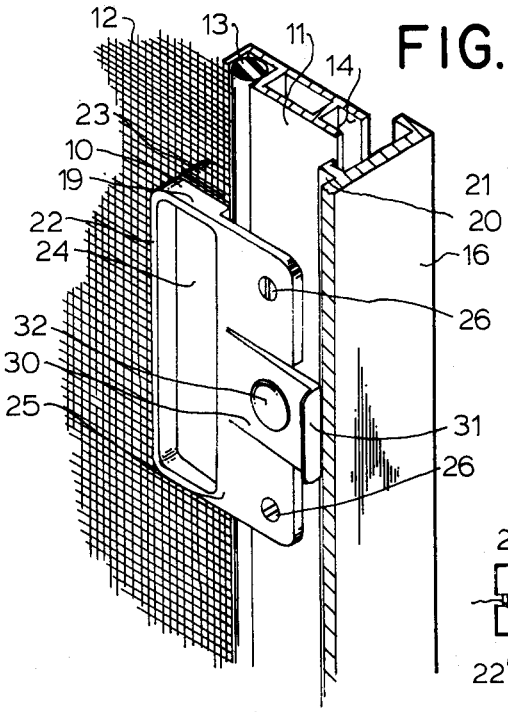
FIG. 1 is a perspective fragmentary view of a sliding screen closure and jamb assembly.
Figure 8:
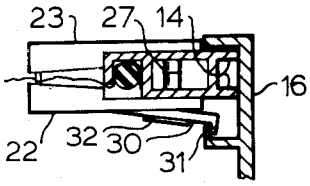
FIG. 8 is a top view of the handle of this invention with the closure, frame and jamb assembly shown in section taken along lines 8—8 of FIG. 7.

Now referring to FIG. 1, a typical installation of the improved handle in accordance with this invention may be seen wherein the handle generally designated 10 is secured to the vertical frame member 11 of a screen having screen cloth 12 secured to the frame by a bead 13 in the manner which is well known in the screen art. The frame member 11 includes an edge extension 14 which mates with the groove 15 of the door jamb generally designated 16. This jamb includes an offset portion 20 on the inside face thereof which includes a re-entrant latch portion 21 used in latching the screen closure when closed.

Figure 2:
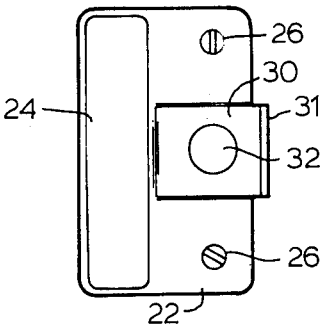
FIG. 2 is a front elevational view of the inside of the handle of FIG. 1.
Figure 3:
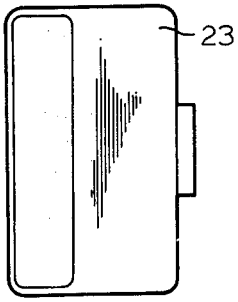
FIG. 3 is an elevational view of the rear or outer side of the handle of FIG. 1.
Figure 4:
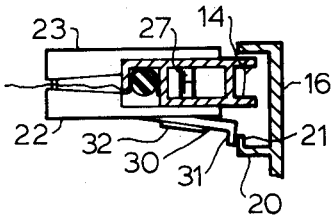
FIG. 4 is a top view of the handle of FIG. 1 with the closure frame and jamb assembly shown in sections taken along lines 4–6 of FIG. 6.

The handle 10 may be seen as being made up of two parts, an inner part 22 and an outer part 23, the differences of which are more apparent in FIGS. 2 through 4 than in FIG. 1. Suffice it to say that the inner part 22 includes a stepped portion 19 defining a finger groove 24. The stepped portion 19 extends inwardly beyond the frame and into engagement with the screen cloth 12. A mating finger groove (unshown in FIG. 1) in part 23 which appears in FIG. 3 serves to embrace the screen wire in the region of the handle 10 and give it a degree of stiffening.

Referring again to FIG. 1, the inner handle portion 22 may be seen as being secured to the frame 11 by a pair of screws 26 which pass through a planar mounting portion 25 of handle 10. Actually the screws pass through boss portions 27 best seen in FIG. 4. Further, the boss portions 27 of FIG. 4 provide joining screw securing areas for the two handle parts 22 and 23. These bosses 27 pass through a pair of spaced holes in the frame 11.

Integral with the handle 22 is a latch finger 30 having an end hook portion 31 and a finger recessed 32. The handle portions 22 and 23 are preferably of molded plastic having a sufficient degree of resiliency such that the finger 30 may be depressed to the level of the plane of a near side of frame 11 to release the hook portion 31 through repeated cycling throughout the life of the screen closure. In the preferred embodiment the handle parts are molded.

The difference between the inner handle 22 and outer portion 23 are more apparent by comparison of FIGS. 2 and 3. The outer inner portion has the same body size as the inner handle 22 but does not include any integral or other latch finger since latching from the interior only is normally all that is required for a screen closure. The finger groove 24A corresponds to groove 24. It may easily be seen that from the exterior the handle viewed in FIG. 3 presents at attractive, simple, clean design. It may include surface ornamentation but none as necessary to provide an attractive, simple handle.

Figure 5:
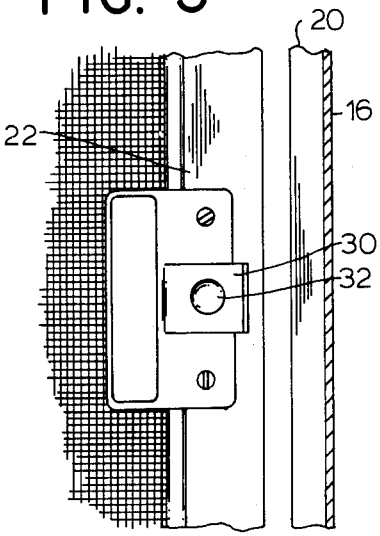
FIG. 5 is an inside fragmentary elevational view of a screen door employing this invention in a nearly closed position.

The interaction between the handle parts 22 and 23 and particularly the latch finger 30 and the re-entrant hook portion 21 of the door jamb may best be seen in FIG. 4 where the screen closure has been moved into a closed but unlocked position. The extension 14 extends into the groove 15 sufficiently that the door is closed to the entrance of flying insects, but may be opened from either the interior or the exterior by placing the fingers in the finger groove 24 or 24A. The door is prevented from further closing movement by the engagement of the outer surface of the end hook portion of the latch finger 30 with the outer surface of the re-entrant hook portion 21 of the door jamb 16. As may be noted in FIGS. 1 and 2 the end hook 31 is of significant length e.g. one inch long, and is capable of absorbing the stress of closure of the screen without damage. Similarly the offset 20 abosrbs the energy of closing the door without latching it. Such closing operation is shown being accomplished in FIGS. 5 and 6.

Figure 6:
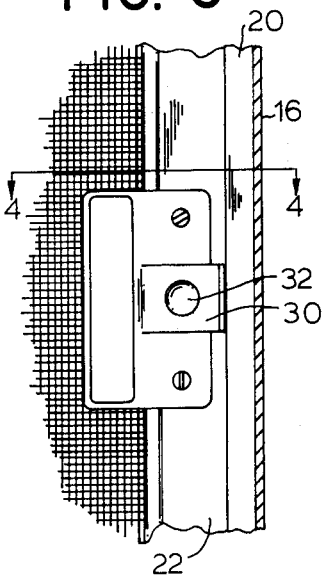
FIG. 6 is an inside fragmentary elevational view similar to FIG. 5 with the door closed but unlocked.
Figure 7:
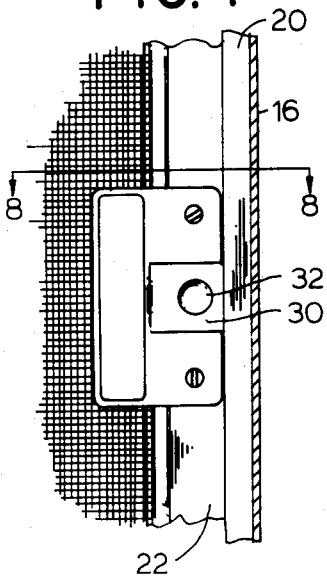
FIG. 7 is a similar view of FIGS. 5 and 6 with the screen door locked.

In FIG. 6 once the door has reached its end of travel and is a latched position. This has been accomplished by depression of the finger 30 inwardly by the user's index finger placed in recess 32, followed by pressure on the finger 30 of the handle to the right in the drawing moving the screen closure into tight engagement with the structure 16. Release of finger 30 allows its end hook 31 to engage the re-entrant portion 21 of jamb 16. This locks the screen closure closed.

Unlocking is accomplished merely by the reverse procedure, namely, insertion of the index finger in the recess 32 depressing the finger inwardly and movement of the screen closure to the left or open.

It is apparent from the foregoing description that this invention is relatively simple and attractive in design and provides each of the following features:

1. Provides an integral finger groove from both inside and out;

2. Has minimum overall thickness, only slightly greater than the screen closure frame itself;

3. Actually serves to stiffen the mid region of the screen closure frame;

4. Actually strengthens the screen cloth in the handle regin by being embraced by the two parts;

5. Provides an integral latch;

6. Provides an automatic stop for the screen closure without latching;

7. It has as its only one moving part the latching finger which is formed integral with the handle;

8. Provides for easy latching and unlatching merely by pressure of the index finger.

9. Eliminates the need to slot out the screen section—which of course would weaken the screen stile.

10. Eliminates all the parts required to be assembled inside the frame section which usually are very small by nature in order to fit inside the section and therefor wear and break easily.

The above described embodiments of this invention are merely descriptive of its principles and are not to be considered limiting. The scope of this invention instead shall be determined from the scope of the following claims including their equivalents.

What is claimed is

1. A handle for a movable screen door having an edge frame and central screen cloth, said screen door movable into a slot-like recess including a reentrant hook portion in the structure against which the door is closed;

said handle comprising an elongated body portion;

means securing said handle to said frame member with said elongated body portion extending in the direction of the length of the screen door frame;

said handle including a spring finger formed integrally therewith and extending above the plane of the screen door frame member in position to engage in an abutting relationship said reentrant hook portion;

said spring finger being deflectable generally into the plane of the screen door to allow it to pass into a slot in the structure against which the screen door is closed and to allow locking engagement with said reentrant hook portion.

2. The combination in accordance with claim 1 wherein the integral finger includes an end hook extending further above the plane of the frame when in an unrestrained position for engaging a portion of the structure against which the screen door is closed.

3. The combination in accordance with claim 1 wherein said handle member includes a planar portion extending generally longitudinally along said frame member for securement thereto.

4. The combination in accordance with claim 1 wherein said handle member includes an end hook which in the engaged or locked position interfits with the reentrant hook portion of the screen door frame.

5. A handle for a movable screen door having an edge frame and central screen cloth, said screen door movable into a slot-like recess including a reentrant hook portion in the structure against which the door is closed;

said handle comprising an elongated body portion;

means securing said handle to said frame member with said elongated body portion extending in the direction of the length of the screen door frame;

said handle including a spring finger formed integrally therewith and extending above the plane of the screen door frame member in position to engage in an abutting relationship said reentrant hook portion;

said spring finger being deflectable generally into the plane of the screen door to allow it to pass into a slot in the structure against which the screen door is closed and to allow locking engagement with said reentrant hook portion; wherein said handle comprises a pair of mating handle members, one embracing the inner and the other embracing the outer face of said edge frame.

6. The combination in accordance with claim 5 wherein each of said handle members includes an integral recess defining a finger groove.

7. The combination in accordance with claim 6 wherein said integral recesses are defined by step regions which place such regions in mere contact in the area of the screen cloth of the screen door.

8. The combination in accordance with claim 6 wherein the portions of said handle members defining finger recesses matingly embrace the screen cloth therebetween and thereby provide localized reinforcement therefor in the handle region of said screen door.

* * * * *